US011764487B2

(12) United States Patent
Crowley et al.

(10) Patent No.: US 11,764,487 B2
(45) Date of Patent: Sep. 19, 2023

(54) DIVERSITY ANTENNA WITH A UNIFORM OMNIDIRECTIONAL RADIATION PATTERN

(71) Applicant: RF VENUE, INC., Ashland, MA (US)

(72) Inventors: Robert Crowley, Sudbury, MA (US); Charles Fendrock, Sudbury, MA (US); Caleb Morrison, Canton, MA (US); Jennifer Chase, Chelsea, VT (US)

(73) Assignee: RF VENUE, INC., Walpole, MA (US)

( * ) Notice: Subject to any disclaimer, the term of this patent is extended or adjusted under 35 U.S.C. 154(b) by 49 days.

(21) Appl. No.: 17/217,077

(22) Filed: Mar. 30, 2021

(65) Prior Publication Data

US 2022/0320755 A1 Oct. 6, 2022

(51) Int. Cl.
*H01Q 21/24* (2006.01)
*H01Q 7/00* (2006.01)
*H01Q 9/40* (2006.01)

(52) U.S. Cl.
CPC ..... *H01Q 21/24* (2013.01); *H01Q 7/00* (2013.01); *H01Q 9/40* (2013.01)

(58) Field of Classification Search
CPC ..... H01Q 21/24; H01Q 7/00; H01Q 9/40; H01Q 1/48
See application file for complete search history.

(56) References Cited

U.S. PATENT DOCUMENTS 8,836,593 B2 9/2014 Crowley et al.
2004/0227669 A1 11/2004 Okado
2010/0253587 A1* 10/2010 Lindenmeier ..... H01Q 21/29 343/858
2010/0265145 A1* 10/2010 Chung ..... H01Q 1/3275 343/895
2012/0032861 A1 2/2012 Crowley et al.

FOREIGN PATENT DOCUMENTS

WO 2019235933 A1 12/2019

* cited by examiner

*Primary Examiner* — Hai V Tran
*Assistant Examiner* — Michael M Bouizza
(74) *Attorney, Agent, or Firm* — KRIEGSMAN & KRIEGSMAN

(57) ABSTRACT

A diversity antenna for receiving radio frequency (RF) signals includes a horizontally-polarized antenna element coupled to a vertically-polarized antenna element in a fixed orthogonal relationship. The vertically-polarized antenna element is a blade antenna which includes a vertically-oriented printed circuit board (PCB) on which is disposed a pair of conductive strips. The horizontally-polarized antenna element includes two loop antennas which are arranged and conductively coupled in parallel. Each loop antenna includes a horizontally-oriented, disc-shaped PCB on which is disposed a pair of conductive loops. To facilitate the orthogonal coupling between the pair of antenna elements, each disc-shaped PCB includes a central slot dimensioned to receive the vertically-oriented PCB. In operation, the independent signal feeds produced by the first and second antenna elements can be processed to reduce any cross-polarization effects present in either signal feed, thereby providing the diversity antenna with full, omnidirectional signal coverage.

10 Claims, 9 Drawing Sheets

DIVERSITY ANTENNA WITH A UNIFORM OMNIDIRECTIONAL RADIATION PATTERN

FIELD OF THE INVENTION

The present invention relates generally to antenna systems and, more particularly, to diversity antennas for use in diversity antenna systems.

BACKGROUND OF THE INVENTION

In wireless communications, multi-path interference occurs as radio frequency (RF) waves reflect off objects located along the signal transmission path. Consequently, as an RF signal arrives at a receiver through a direct signal path, numerous indirect signal paths caused from reflections arrive at the receiver at slightly varying time intervals. This multi-path transmission of an RF signal creates interference, which can create cross-polarization of the RF signal (i.e., radiation orthogonal to the desired radiation plane). Due to cross-polarization of the RF signal, certain types of conventional RF antennas often experience deep null or dropout conditions in the received signal, which is highly undesirable.

To remedy the shortcomings associated with multi-path interference, an antenna diversity scheme is often implemented in which a network of independent antennas is positioned at separate locations and arranged at different angles within the designated area in order to improve coverage quality and reliability. The feed from each of the network of antennas is then typically transmitted to one or more receivers for signal processing. As such, systems which rely upon antenna diversity are utilized in a wide range of applications, from cellular communication systems to microphone systems used in performance venues, such as places of worship, sport venues, concert arenas, convention halls, and the like.

In order to operate in an optimal fashion, antenna systems of the type as described above require the user to precisely position and angle each of the network of antennas. Most notably, if at least two of the individual antennas are not oriented in orthogonal planes, signal dropouts and other harmful effects of cross-polarization remain at risk.

Additionally, it has been found that low-power wireless microphone systems are particularly susceptible to the harmful effects of multi-path interference. Since wireless microphones are designed for portability and movement by the user, the transmission path of an RF signal generated by a wireless microphone is constantly changing in terms of its point of origin and angle of orientation. This transmission path variance not only introduces signal reflections but also prevents an antenna from being precisely polarized in the signal transmission plane in order to minimize the risk of signal nulls or dropouts.

To resolve this issue, diversity antennas are well known and commonly utilized in the art. A diversity antenna is a unitary module which is constructed with two independent antennas that are fixedly arranged in a defined spatial relationship in order to improve the quality and reliability of wireless communications. Notably, through the use of two independent antennas, which are fixedly arranged in different radiation planes, the effects of multi-path interference are significantly reduced. As a result, a diversity antenna receiver in connection with the diversity antenna is able to process the multiple antenna feeds upon detecting unwanted effects, thereby resulting in an overall improvement in signal quality with fewer dropouts and noise.

For example, in U.S. Pat. No. 8,836,593 to R. J. Crowley et al., (hereinafter "the '593 patent"), a diversity antenna is described which comprises a fin-type blade antenna and a deployable dipole antenna that are arranged in an orthogonal relationship relative to one another, the disclosure of which is incorporated herein by reference. In use, the blade antenna is designated to receive RF energy that is vertically polarized, whereas the dipole antenna is designated to receive RF energy that is horizontally polarized. In this manner, the use of two independent antennas, configured in an orthogonal arrangement, significantly resolves cross-polarization fades and dropouts. Additionally, the consolidation of multiple antennas into a single device minimizes overall number of system components, including feedlines, stands, and the like, which would otherwise clutter the designated area.

Although well known and widely used in the art, conventional diversity antennas have certain limitations. As noted above, the '593 patent relies upon a dipole antenna to receive horizontally polarized RF energy. However, the radiation pattern for a dipole antenna within the horizontal plane often experiences a weakening, or a null effect, directly along the axis defined by the dipole antenna. As a result, full omnidirectional signal coverage in the horizontal plane has been found to be difficult to achieve. Without uniform signal coverage in the horizontal plane, the performance of conventional diversity antennas is rendered sub-optimal.

SUMMARY OF THE INVENTION

It is an object of the present invention to provide a novel diversity antenna for use in a diversity antenna system.

It is another object of the present invention to provide a diversity antenna as described above which includes two independently operating antenna elements.

It is yet another object of the present invention to provide a diversity antenna as described above wherein the two independent antenna elements are configured to provide orthogonal signal coverage.

It is still another object of the present invention to provide a diversity antenna as described above which produces a uniform, omnidirectional radiation pattern in both the horizontal and vertical planes.

It is yet still another object of the present invention to provide a diversity antenna as described above which is designed to minimize the effects of signal cross-polarization resulting from multi-path interference.

It is another object of the present invention to provide a diversity antenna as described which has a limited number of parts, is inexpensive to manufacture, and is easy to use.

Accordingly, as one feature of the present invention, there is provided a diversity antenna for receiving radio frequency (RF) signals, the diversity antenna comprising (a) a first antenna element for receiving RF signals, the first antenna element being vertically polarized, and (b) a second antenna element for receiving RF signals, the second antenna element being horizontally polarized, the second antenna element operating independently of the first antenna element, the second antenna element being coupled to the first antenna element in a fixed orthogonal relationship relative thereto, (c) wherein the first antenna element produces a generally circular azimuth radiation pattern in the vertical plane and the second antenna element produces a generally circular azimuth radiation pattern in the horizontal plane, the combined radiation patterns reducing any cross-polarization effects in RF signals received by the diversity antenna.

As another feature of the present invention, there is provided a method for reducing cross-polarization effects in a radio frequency (RF) signal received by a diversity antenna, the method comprising the steps of (a) providing a first antenna element for receiving RF signals, the first antenna element being vertically polarized and producing a generally circular azimuth radiation pattern in the vertical plane, (b) providing a second antenna element for receiving RF signals, the second antenna element being horizontally polarized and producing a generally circular azimuth radiation pattern in the horizontal plane, and (c) fixedly coupling the first and second antenna elements in an orthogonal relationship to yield a unitary diversity antenna which is designed to reduce any cross-polarization effects in received RF signals.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts:

FIG. 5(*b*) is a graph of actual measurements of signal strength in relation to signal source angle received by the orthogonally polarized diversity antenna shown in FIG. 2, the graph illustrating a notable improvement in reducing the effects of signal cross-polarization which is achieved by the diversity antenna of the present invention.

DETAILED DESCRIPTION OF THE INVENTION

Diversity Antenna System 11

Figure 1:
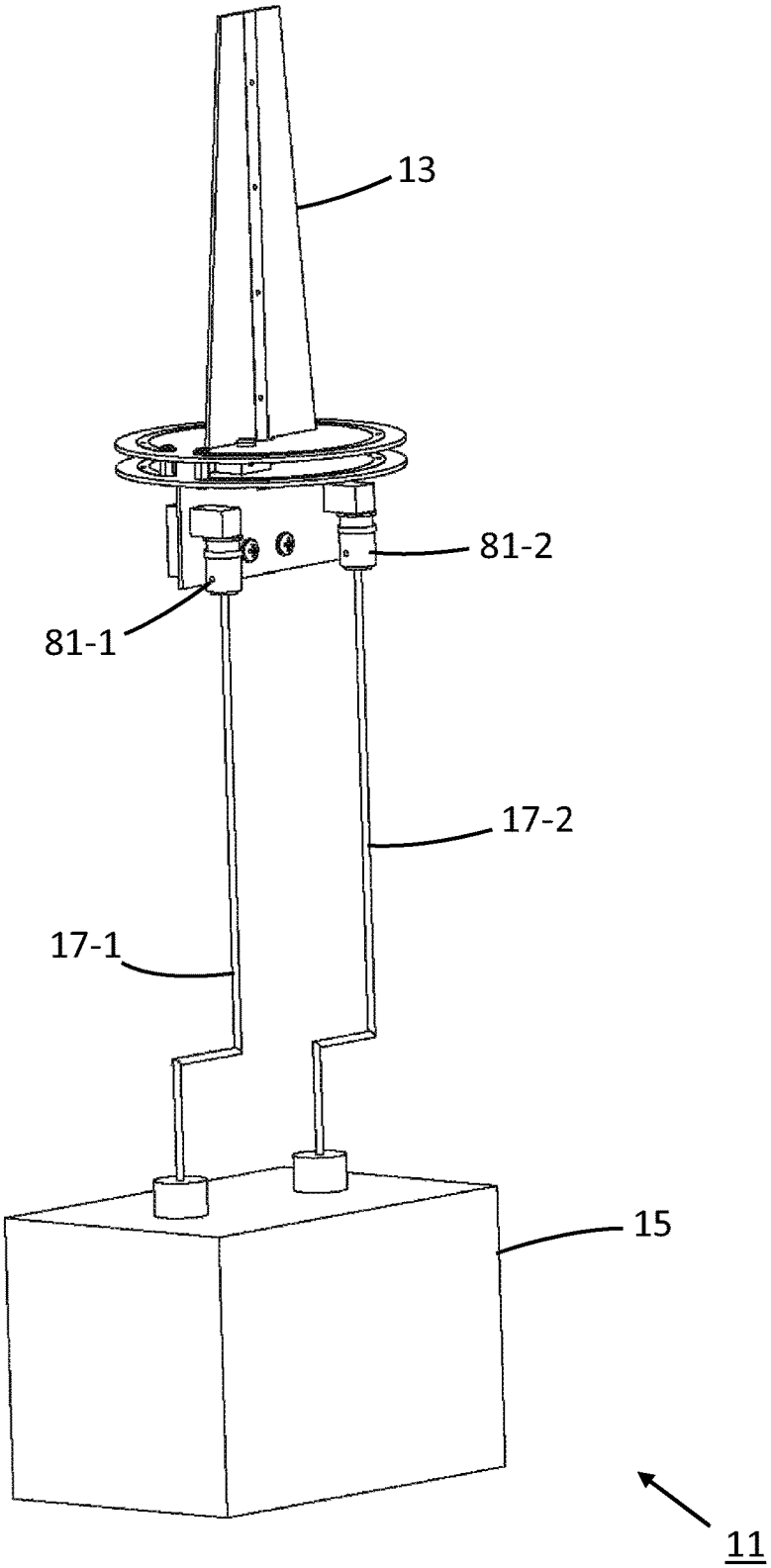
FIG. 1 is a front top perspective view of a diversity antenna system constructed according to the teachings of the present invention.

Referring now to FIG. 1, there is shown a diversity antenna system constructed according to the teachings of the present invention, the system being defined generally by reference numeral 11. As will be explained in detail below, system 11 is designed with a novel construction that ensures the reception of radio frequency (RF) signals in a wide range of directions and orientations with minimal risk of deep null or dropout conditions, which can result from signal cross-polarization.

As can be seen, diversity antenna system 11 comprises a diversity antenna 13 connected to a diversity antenna receiver 15 via a pair of coaxial-type feedlines 17-1 and 17-2. In use, the individual antenna feeds derived from diversity antenna 13 are delivered by feedlines 17 to receiver 15, which then processes the feeds in the correct phase relationship to yield an output signal with broad bandwidth and high gain.

As will be described in detail below, the unique construction of diversity antenna 13 serves as the principal novel feature of the present invention. In particular, diversity antenna 13 is equipped with a novel loop-type omnidirectional antenna that provides a full 360-degree radiation pattern in the horizontal plane. As a result, diversity antenna 13 is able to uniformly receive RF signals from all horizontal directions relative thereto with minimal risk of deep null or dropout conditions created from signal cross-polarization.

Diversity Antenna 13

Figure 2:
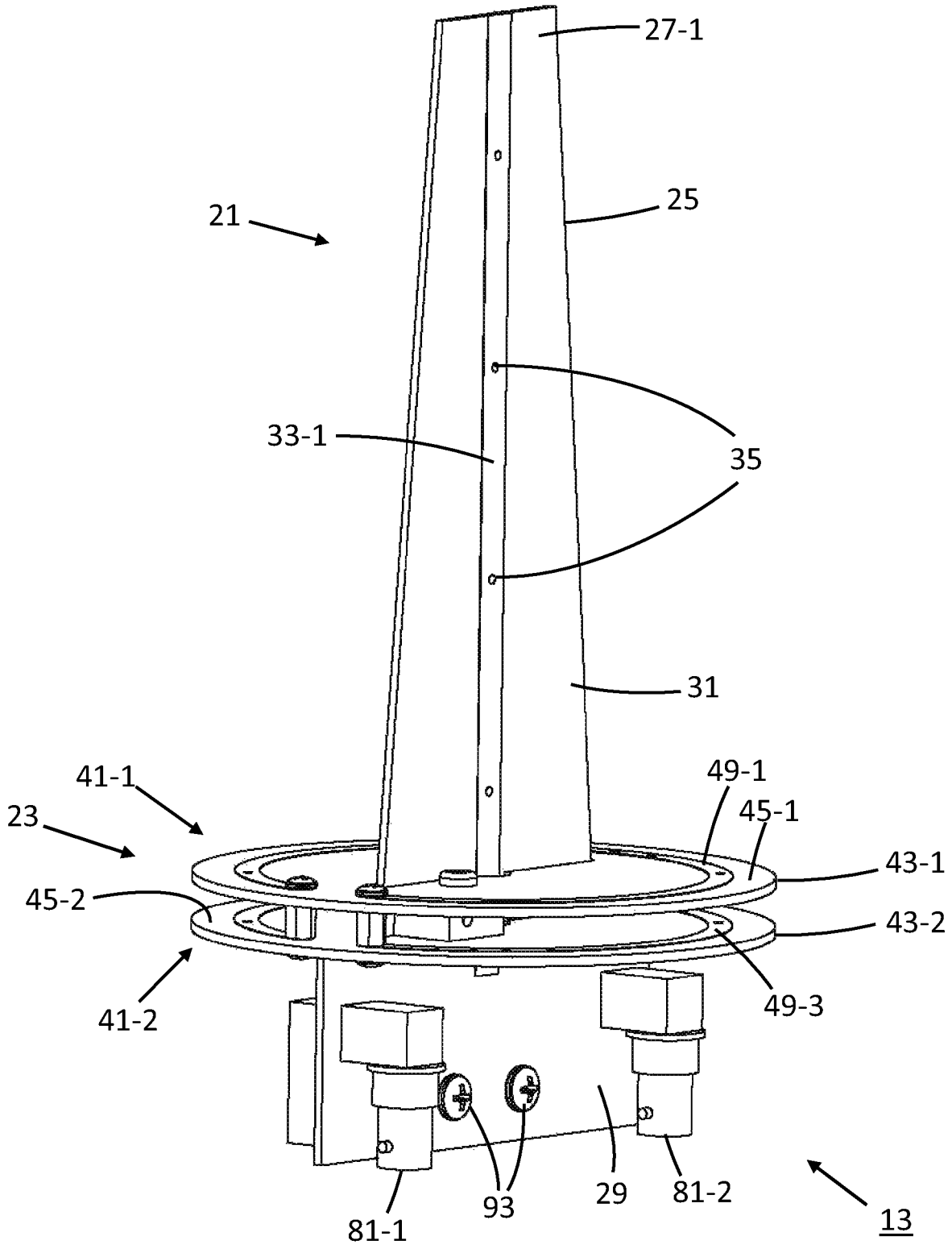
FIG. 2 is front top perspective view of the diversity antenna shown in FIG. 1.
Figure 3:
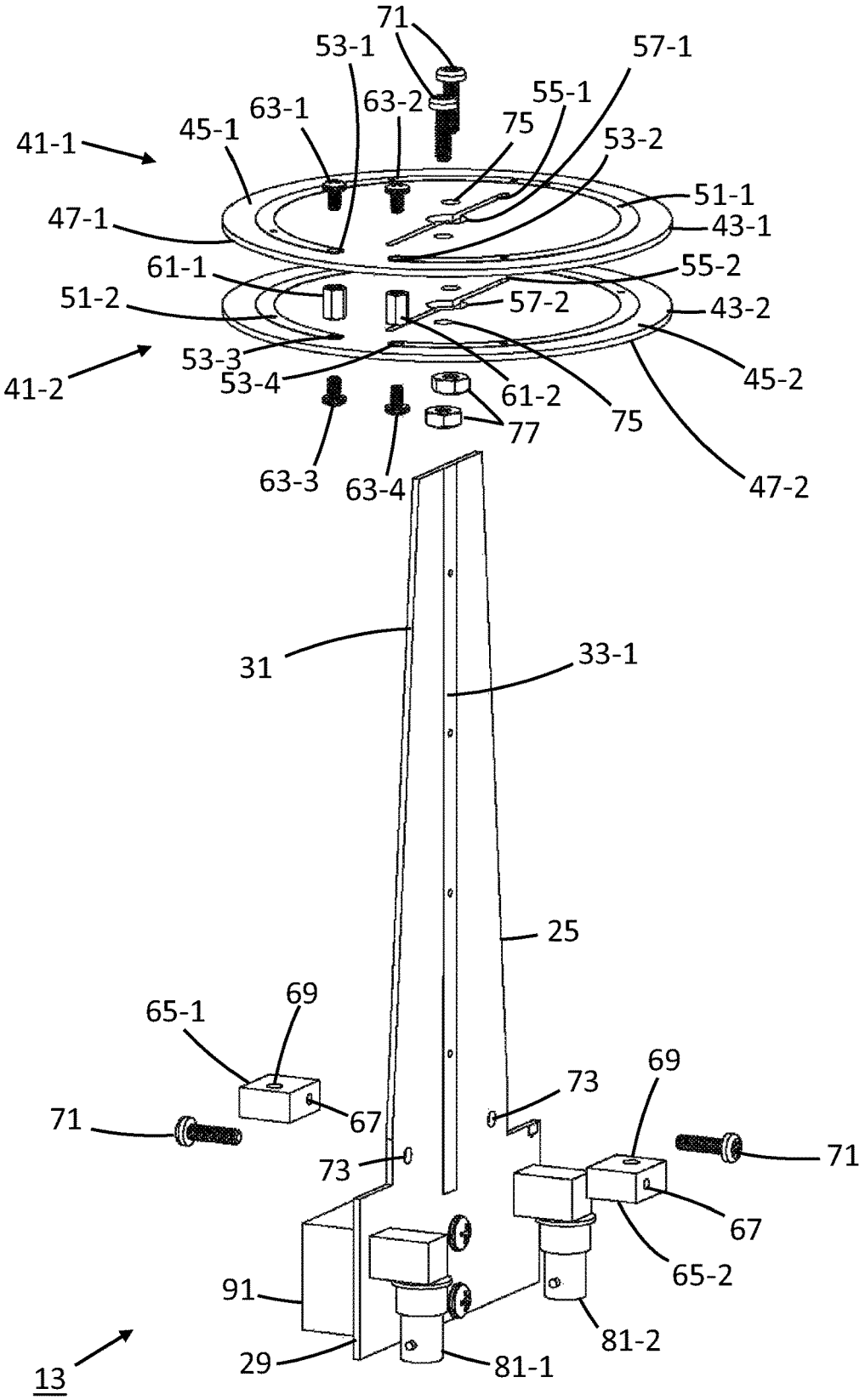
FIG. 3 is a partially exploded, front top perspective view of the diversity antenna shown in FIG. 2.
Figure 4A:
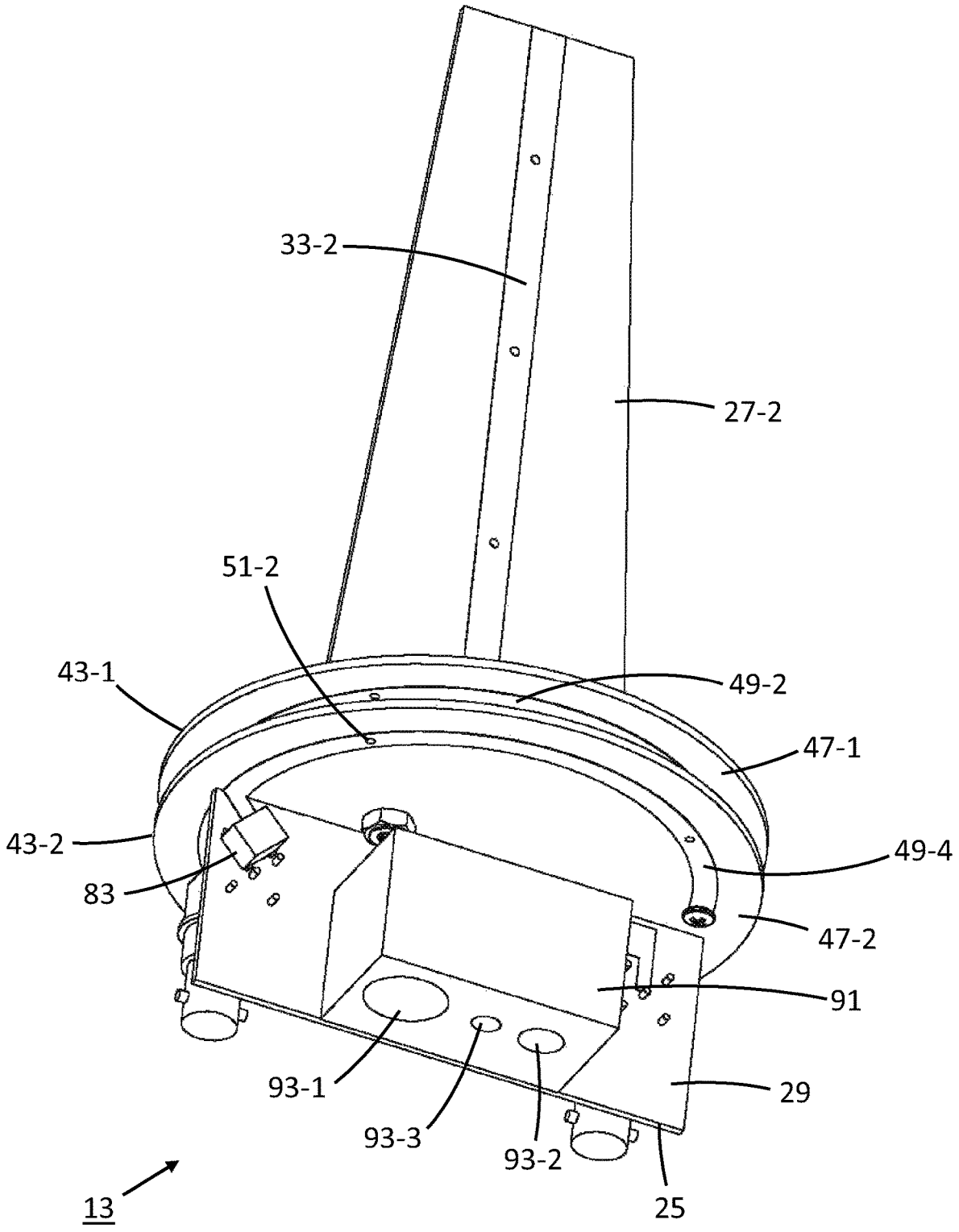
FIGS. 4(*a*)-(*d*) are rear bottom perspective, rear plan, top plan, and bottom plan views, respectively, of the diversity antenna shown in FIG. 2.
Figure 4B:
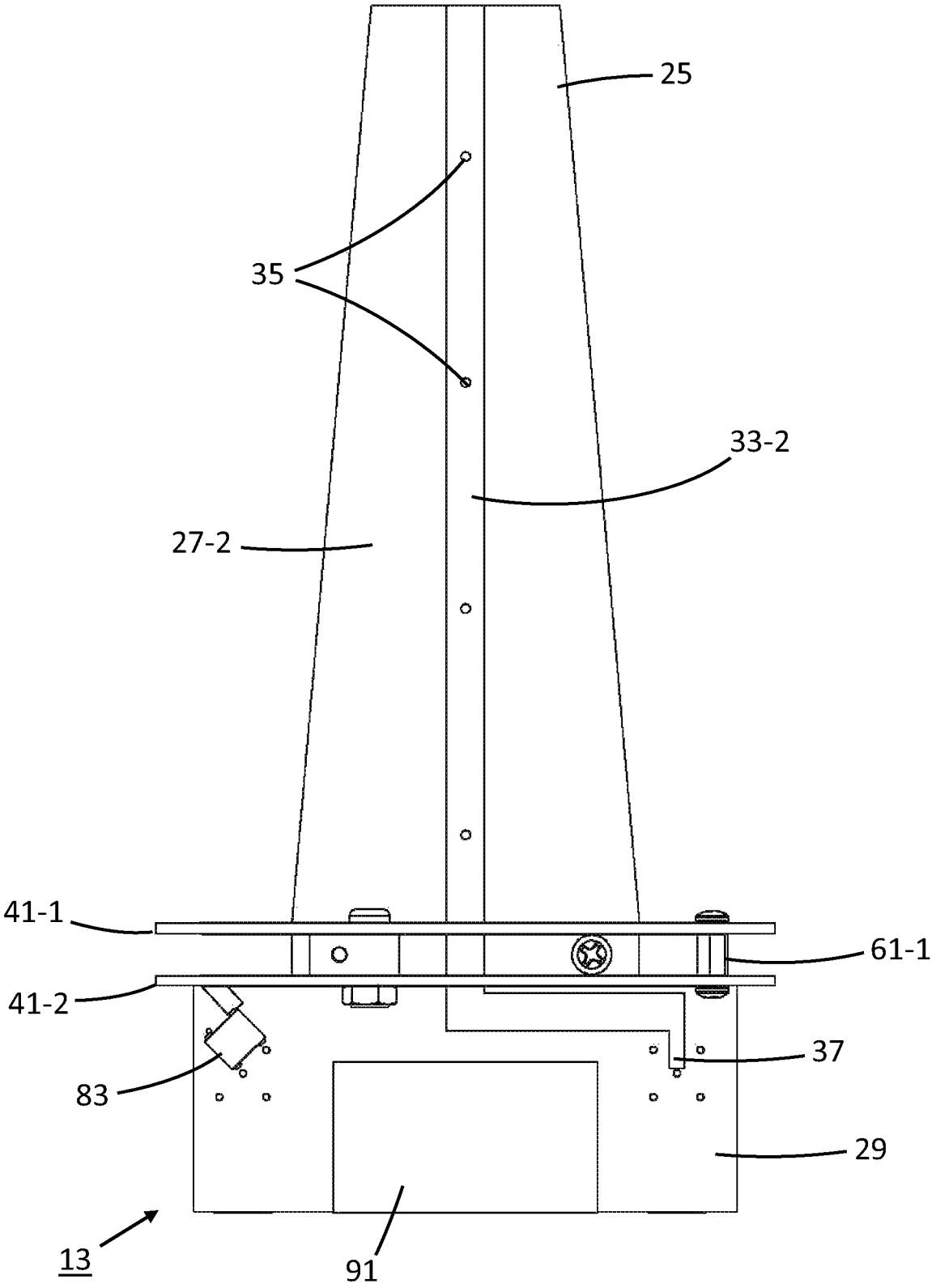
Figure 4C:
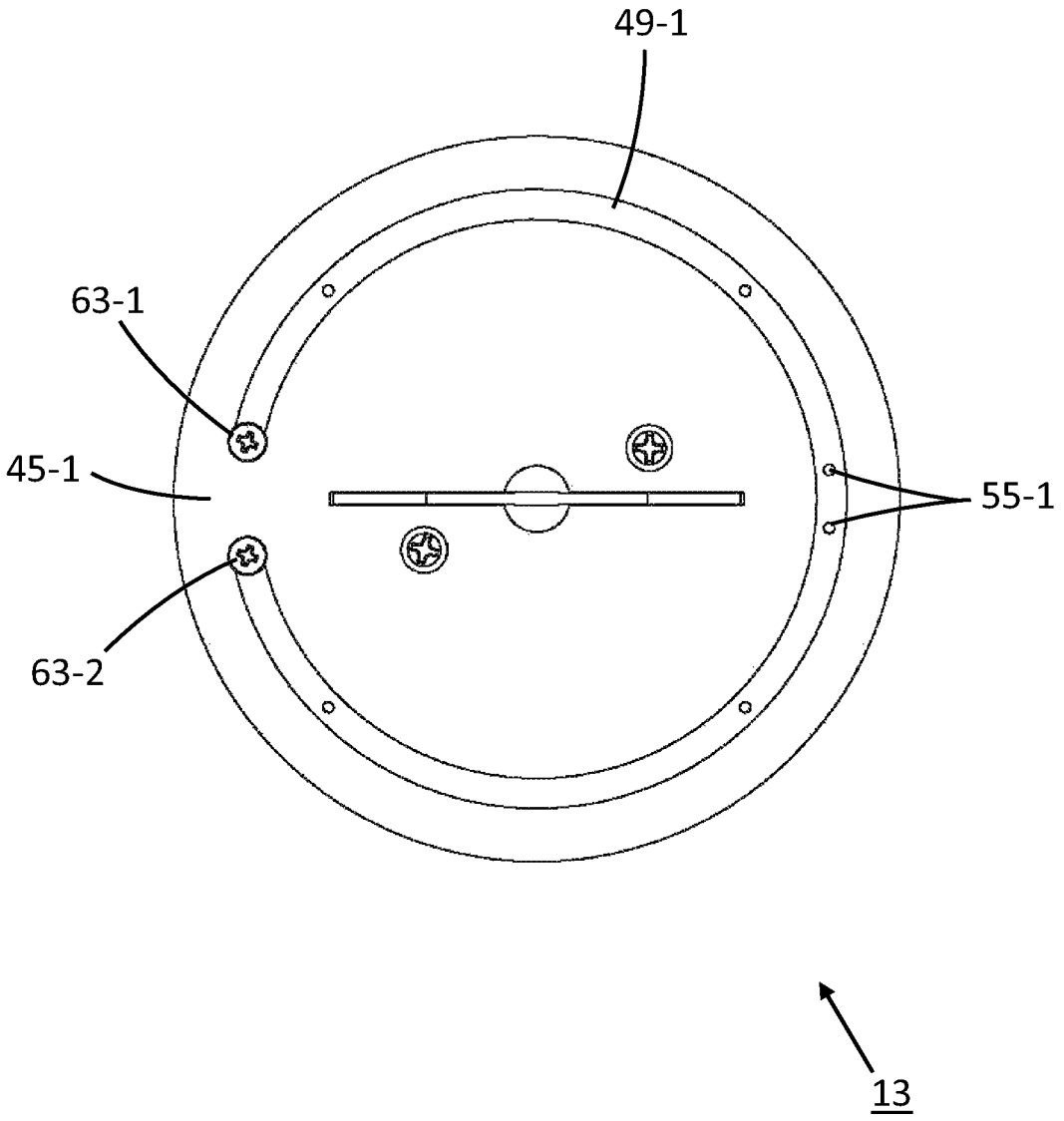
Figure 4D:
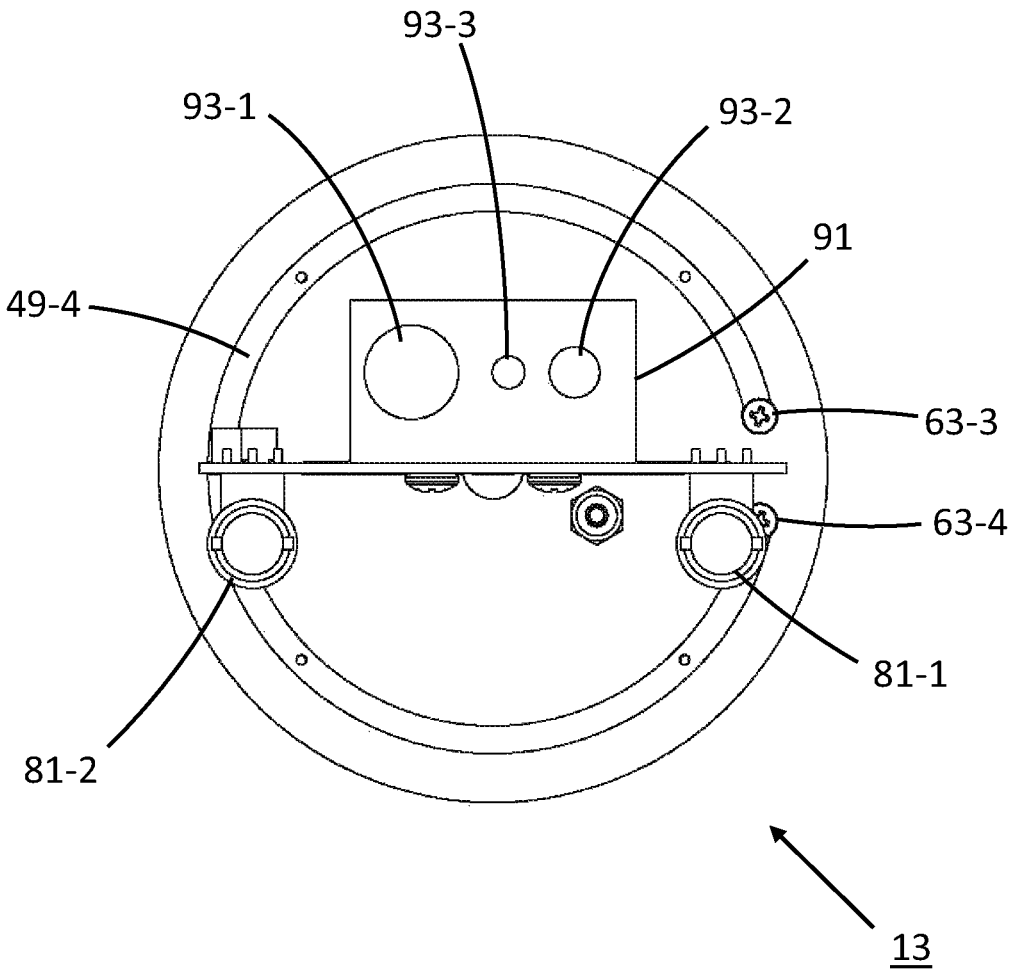

As referenced above, diversity antenna 13 comprises two independent, non-interfering, orthogonal antenna elements which together minimize the deleterious effects of multipath signal interference in order to enhance the quality and reliability of wireless communications. More specifically, as shown in FIGS. 2, 3, and 4(*a*)-(*d*), diversity antenna 13 comprises (i) a blade, or fin, antenna element 21 that is vertically polarized, and (ii) a loop antenna element 23 that is horizontally polarized, with antenna elements 21 and 23 fixedly coupled together in a precise orthogonal relationship to form a compact, unitary device.

Antenna element 21 is constructed as a blade, or fin, antenna which is optimized to receive RF signals that are vertically polarized. As can be seen, vertically-polarized antenna element 21 comprises a vertically-oriented printed circuit board (PCB) 25 that is preferably constructed of a glass-reinforced epoxy laminate material, such as a standard FR-4 epoxy laminate.

Vertical PCB 25 is in the form of an enlarged flattened board with opposing faces, or sides, 27-1 and 27-2. Additionally, PCB 25 is shaped to include (i) an enlarged, rectangular bottom portion 29, which is designed primarily to support various components for mounting and electrically connecting antenna element 25-1 to auxiliary components, and (ii) a trapezoidal, or fin-shaped, upper portion 31, which serves as the foundation, or base, on which vertically-polarized antenna element 21 is constructed.

A pair of thin conductive strips 33-1 and 33-2, each constructed of a highly conductive material, such as copper, is formed onto and extends the length of opposing faces 27-1 and 27-2, respectively, of PCB 25 in direct alignment with one another. Strips 33 may be formed using known printed circuit board etching techniques or applied using conductive copper foil, the former being preferred for consistency, strength, and lower costs. A plurality of plated thru-holes 35 extends transversely thru PCB 25 between conductive strips 33 to establish conductive connection therebetween at various points along their lengths.

As seen most clearly in FIG. 4(*b*), conductive strip 33-2 terminates in a distal end 37 located on bottom portion 29 of PCB 25. As will be explained further below, auxiliary electrical connection to vertically-polarized antenna element 21 is established through distal end 37.

Referring back to FIGS. 2, 3, and 4(*a*)-(*d*), horizontally-polarized, omnidirectional antenna element 23 is constructed as a compact and unitary component that is directly mounted on vertically-polarized antenna element 21 in a precise orthogonal relationship relative thereto. As can be seen, omnidirectional antenna element 23 comprises a pair of spaced apart loop antennas 41-1 and 41-2 that are electrically connected in parallel. As can be appreciated, omnidirectional antenna element 23 provides a full, 360-degree, radiation pattern in the horizontal plane, which is a principal object of the present invention. Additionally, the unique mounting of omnidirectional antenna element 23 onto vertically-polarized antenna element 21 yields a diversity antenna 13 which is high performing, compact, and inexpensive to manufacture.

As can be seen, loop antennas 41-1 and 41-2 are constructed using upper and lower horizontally-oriented printed circuit boards (PCB) 43-1 and 43-2, respectively. Each horizontal PCB 43 is preferably constructed of a glass-reinforced epoxy laminate material, such as a standard FR-4 epoxy laminate.

Upper horizontal PCB 43-1 has a disc-shaped configuration with a flattened top surface 45-1 and a flattened bottom surface 47-1. A pair of thin conductive strips 49-1 and 49-2, each constructed of a highly conductive material, such as copper, is formed onto opposing surfaces 45-1 and 47-1, respectively, of PCB 43-1 in direct alignment with one another. A set of plated thru-holes 51-1 extends transversely thru PCB 43-1 between conductive strips 49-1 and 49-2 to establish conductive connection therebetween at various points along their lengths. As can be seen, each conductive strip 49 has a circular, loop-type configuration with a pair of spaced apart, transverse holes 53-1 and 53-2 formed at its terminal ends. For reasons to become apparent below, upper PCB 43-1 is provided with a centered, linear slot 55-1 that extends only a portion of its length, slot 55-1 being shaped with an enlarged circular opening 57-1 at its approximate midpoint.

In a similar fashion, lower horizontal PCB 43-2 has a disc-shaped configuration with a flattened top surface 45-2 and a flattened bottom surface 47-2. A pair of thin conductive strips 49-3 and 49-4, each constructed of a highly conductive material, such as copper, is formed onto opposing surfaces 45-2 and 47-2, respectively, of PCB 43-2 in direct alignment with one another. A set of plated thru-holes 51-2 extends transversely thru PCB 43-2 between conductive strips 49-3 and 49-4 to establish conductive connection therebetween at various points along their lengths. As can be seen, each conductive strip 49 has a circular, loop-type configuration with a pair of spaced apart, transverse holes 53-3 and 53-4 formed at its terminal ends. Additionally, lower PCB 43-2 is provided with a centered, linear slot 55-2 that extends only a portion of its length, slot 55-2 being shaped with an enlarged circular opening 57-2 at its approximate midpoint.

A pair of conductive spacers 61-1 and 61-2 is disposed between upper and lower PCBs 43 to help (i) establish electrical connection between conductive strips 49 and (ii) maintain the predetermined, requisite spacing between loop antennas 41-1 and 41-2. Each spacer 61 is constructed of a conductive material, such as stainless steel, and is internally threaded, for reasons to become apparent below.

Spacers 61 are disposed in direct contact against the terminal ends of conductive strips 49-2 and 49-3. Metal screws 63-1 and 63-3 are disposed through holes 53-1 and 53-3, respectively, and into threaded engagement with opposing ends of conductive spacer 61-1. Similarly, metal screws 63-2 and 63-4 are disposed through holes 53-2 and 53-4, respectively, and into threaded engagement with opposing ends of conductive spacer 61-2. As such, screws 63 help secure electrical connection between the terminal ends of all conductive strips 49.

A pair of coupling blocks 65-1 and 65-2 are provided to fixedly mount loop antennas 41 onto vertical PCB 25 in a fixed, orthogonal relationship relative thereto. Each block 65 is preferably constructed of a rigid and durable dielectric material and is shaped to includes a transverse horizontal bore 67 and a transverse vertical bore 69 that are offset from one another. As part of the assembly process, which will be explained further in detail below, blocks 65 are disposed on opposing faces 27 of vertical PCB 25 at the base of fin-shaped upper portion 31 and are fixedly secured thereto by inserting a non-conductive, screw-type fastener 71 through horizontal bore 67 and into threaded engagement with a threaded hole 73 preformed in PCB 25.

Additionally, with blade-shaped upper portion 31 disposed through slots 55, loop antennas 41 are secured to vertically-polarized antenna element 21 by inserting a non-conductive, screw-type fastener 71 through preformed holes 75 in upper and lower horizontal PCBs 43 as well as through vertical bore 69 in each coupling block 65, with fastener 71 being tightly secured with a complementary hex nut 77.

As seen most clearly in FIGS. 2 and 3, first and second RF connectors 81-1 and 81-2 are mounted on front side 27-1 of PCB 25 within enlarged bottom portion 29. Each connector 81 is preferably in the form of a right-angle, Bayonet Neill-Concelman (BNC) connector in order to allow for quick RF coupling. The right-angle, downward positioning of connectors 81 allows for the connection of coaxial feedlines 17 in a neat and simplified manner.

As can be appreciated, connector 81-1 is designed to receive the signal feed from fin-type, or vertical, antenna element 21. As such, connector 81-1 is electrically connected to distal end 37 of conductive strip 33-2 by PCB tracing on PCB 25.

Similarly, connector 81-2 is designed to receive the signal feed from omnidirectional, or horizontal, antenna element 23. As such, connector 81-2 is electrically connected to conductive strip 49-4 through soldering and PCB tracing. Preferably, an impedance matching transformer 83 is mounted on rear side 27-2 of PCB 25 along the signal path between strip 49-2 and connector 81-2, as seen most clearly in FIGS. 4(*a*) and 4(*b*). In use, impedance matching transformer 83 serves to match load impedances between the circuitry on vertical PCB 25 and horizontal PCBs 43.

A mounting block 91 is mounted on rear side 27-2 of PCB 25 within enlarged bottom portion 29 and is secured thereto with screws 93. As seen most clearly in FIGS. 4(*a*) and 4(*d*), mounting block 91 is shaped to include three internally-threaded, vertical bores 93-1, 93-2, and 93-3 of varying diameters (e.g., ⅝" in diameter and 27 threads per inch (TPI), ⅜" in diameter and 16 TPI, and ¼" in diameter and 20 TPI). Bores 93 enable diversity antenna 13 to be screwed onto the free end of an antenna stand (not shown) or other similar device for mounting purposes. The location of mounting block 91 adequately away from conductive strips 49 on horizontal antenna element 23 ensures that the risk of capacitive load and field distortion is minimized to the greatest extent possible.

Assembly of Diversity Antenna 13

Referring now to FIGS. 2, 3, and 4(*a*)-4(*d*), diversity antenna 13 is preferably assembled in the following manner.

First, mounting block 91 and impendence matching transformer 83 are mounted in their proper respective positions on rear side 27-2 of vertical PCB 25 within bottom portion 29, with transformer 83 electrically connected to PCB tracing through spot soldering. Similarly, BNC connectors 81 are mounted in their proper respective positions on front side 27-1 of vertical PCB 25 within bottom portion 29.

As seen most clearly in FIG. 3, conductive spacers 61-1 and 61-2 are then mounted onto the top surface 45-2 of lower horizontal PCB 43-2 over holes 53-3 and 53-4, respectively, which are located at the terminal ends of conductive strip 49-3. Screws 63-3 and 63-4 are driven thru holes 53-3 and 53-4, respectively, and into threaded engagement with spacers 61-1 and 61-2, respectively, to secure spacers 61 to lower PCB 43-2.

Thereafter, lower horizontal PCB 43-2 is mounted onto vertical PCB 25 by inserting the distal end of fin-shaped upper portion 31 through slot 55-2 with spacers 61 oriented upward. Lower horizontal PCB 43-2 slides down vertical PCB 25 until bottom surface 47-2 of lower PCB 43-2 abuts the widened top edge, or shoulder, of bottom portion 29 on vertical PCB 25. Preferably, tracing on the underside of lower horizontal PCB 43-2 is then conductively welded to vertical PCB 25 to establish an electrical connection between the two printed circuit boards.

With lower horizontal PCB 43-2 disposed as such, coupling blocks 65 are disposed in their proper positions on opposing surfaces of vertical PCB 25. Each block 65 is then fixedly secured to vertical PCB 25 by driving a screw 71 through preformed transverse horizontal bore 67 and, in turn, into engagement with a corresponding threaded hole 73 formed in vertical PCB 25 at the base of fin portion 31. Tightening of screws 71 causes coupling blocks 65 to apply pressure onto top surface 45-2 which, in turn, ensures lower horizontal PCB 43-2 is maintained in a horizontal orientation (i.e., orthogonal in relation to vertical PCB 25).

Upper horizontal PCB 43-1 is then mounted onto vertical PCB 25 by inserting the distal end of fin portion 31 through slot 55-1. Upper horizontal PCB 43-1 slides down vertical PCB 25 until bottom surface 47-1 is disposed in direct contact with both spacers 61 and coupling blocks 65. Metal screws 63-1 and 63-2 are then driven thru holes 53-1 and 53-2, respectively, and into threaded engagement with spacers 61-1 and 61-2, respectively, to electrically connect together all conductive strips 49 on horizontal antenna element 23. Additionally, non-conductive screws 71 are passed through aligned holes 75 in both horizontal PCBs 43, inserted through vertical bores 69 in coupling blocks 65, and secured with associated hex nuts 77. In this manner, coupling blocks 65 serve not only to fixedly couple horizontal PCBs 43 to vertical PCB 25 but also to maintain horizontal PCBs 43 in the required, fixed spacing, parallel relationship.

It should be noted that enlarged openings 57-1 and 57-2 in slots 55-1 and 55-2, respectively, provide adequate clearance to prevent horizontal PCBs 43 from contacting conductive strips 33-1 and 33-2 on vertical antenna element 21.

Actual Test Results Achieved Using Diversity Antenna 13 in Relation to a Comparative Antenna It should be noted that orthogonally-polarized diversity antenna 13 was constructed in the manner set forth in detail above and, in turn, tested to determine its effectiveness in reducing or eliminating deep cross-polarization nulls and reduce signal dropouts for a full 360 degrees of azimuthal coverage. For comparative purposes, a conventional, linearly, or single-plane, polarized antenna, hereinafter referred to simply as the comparative antenna, was tested to determine its effectiveness in receiving the same test signal over a full 360 degrees of azimuthal coverage. The results of the aforementioned testing are detailed below. The following results are provided for illustrative purposes only and are not intended to limit the scope of the present invention.

Figure 5A:
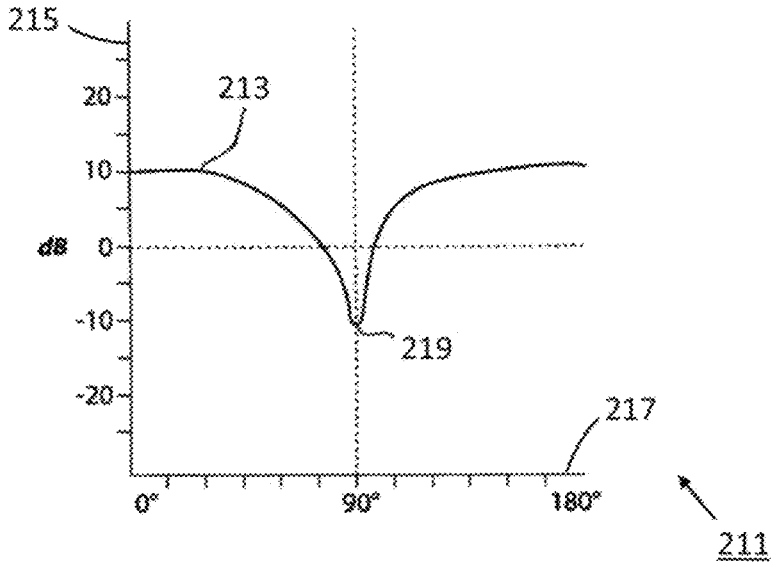
Prior Art Fig. 5(a)
FIG. 5(*a*) is a graph of actual measurements of signal strength in relation to signal source angle received by a single, conventional, linearly polarized antenna.
Figure 5B:
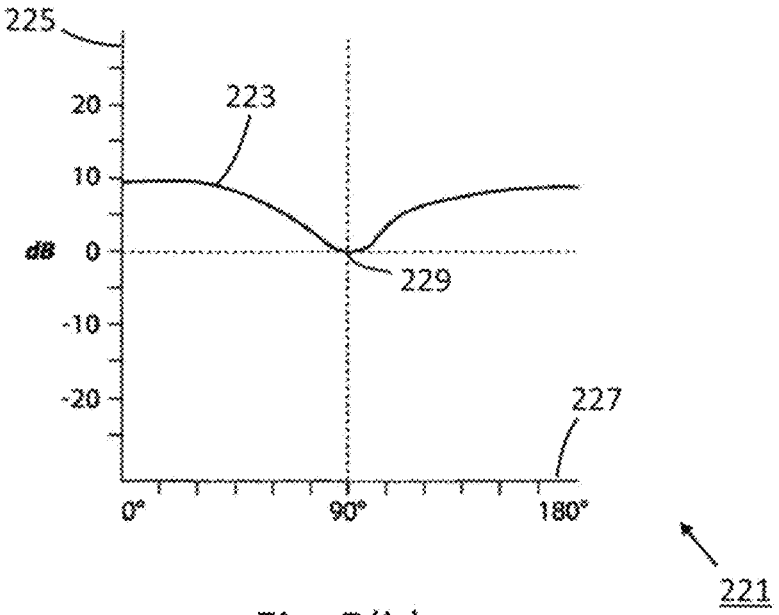

FIGS. 5(*a*) and 5(*b*) are actual graphs which illustrate signal strength relative to the linear polarization angle for a test signal received by each of the comparative antenna and diversity antenna 13, respectively. Together, the aforementioned graphs illustrate a notable increase in signal strength coverage that is achieved by the present invention.

Specifically, in FIG. 5(*a*), a graph for the comparative antenna is shown, the graph being identified generally by reference numeral 211. In graph 211, a measured test signal 213 is represented along vertical axis 215 in terms of signal strength (dB) and along horizontal axis 217 in terms of the horizontal angle of the linear signal source (degrees). As can be seen, the comparative antenna experiences an undesired null condition 219 at an angle of 90 degrees. In the present example, null condition 219 results in a signal strength drop of 20 dB below its maximum signal strength. As can be appreciated, a 20 dB loss in signal strength is considerably high, and sufficient to produce a signal fade that can be heard as noise.

By comparison, in FIG. 5(*b*), a graph for diversity antenna 13 is shown, the graph being identified generally by reference numeral 221. In graph 221, a measured test signal 223 is represented along vertical axis 225 in terms of signal strength (dB) and along horizontal axis 227 in terms of the horizontal angle of the linear signal source (degrees). As can be seen, diversity antenna 13 effectively compensates for an undesired null condition 229 experienced at an angle of 90 degrees by combining the two independent orthogonally-polarized signal feeds together, thereby minimizing the effects of null condition 229. Notably, the effects of null condition 229 are reduced by approximately 10 dB, thereby resulting in a signal strength drop of only 10 dB below its maximum signal strength, which is a considerable improvement.

Figure 6A:
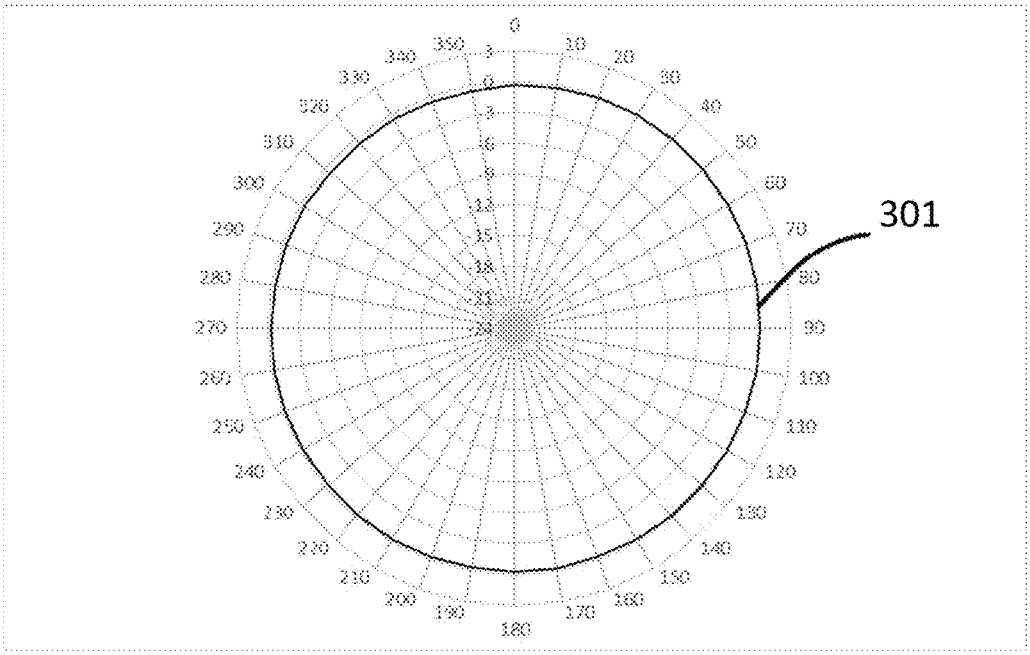
FIGS. 6(*a*) and 6(*b*) are graphs of actual measurements of the azimuth radiation patterns for the vertically-polarized and horizontally-polarized antenna elements, respectively, of the diversity antenna shown in FIG. 2, the graphs together illustrating the improvement in the uniformity of signal gain in all directions that is achieved by the present invention.
Figure 6B:
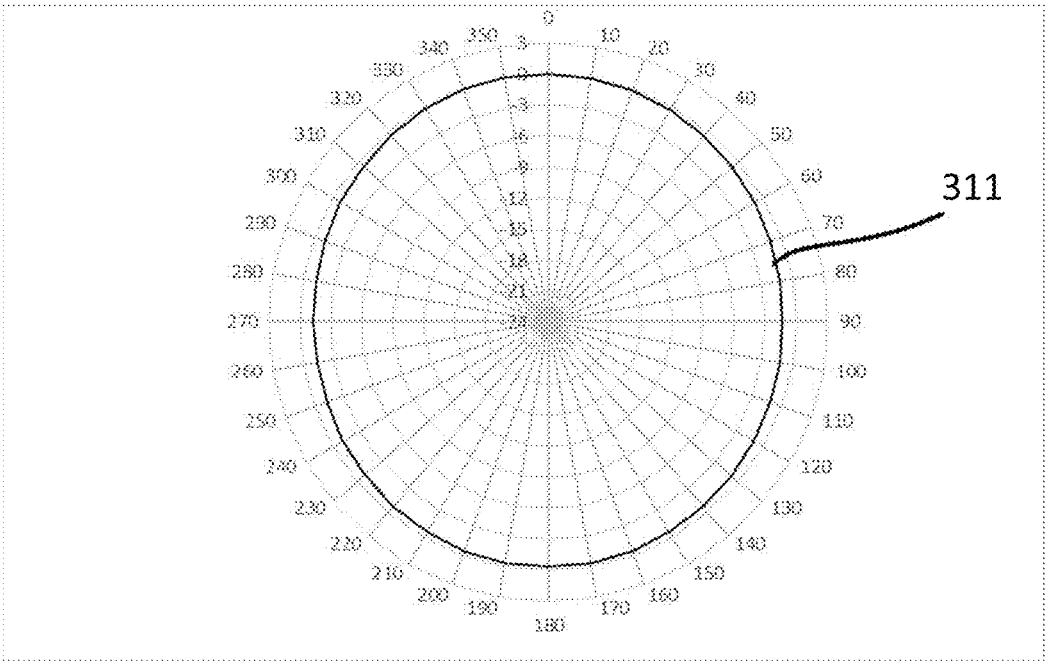

Referring now to FIGS. 6(*a*) and 6(*b*), there are shown vector plots of (i) the azimuthal radiation pattern for vertically-polarized antenna element 21, and (ii) the azimuthal radiation pattern for horizontally-polarized antenna element 23, respectively. By superimposing the two radiation patterns, it is illustrated that diversity antenna 13 has a nearly uniform, 360-degree, radiation pattern for both vertically and horizontally polarized modes of operation, which is a principal object of the present invention.

In FIG. 6(*a*), an actual vector plot of the azimuth radiation pattern 301 for vertically-polarized antenna element 21 is shown. As can be seen, azimuth plane pattern 301 is nearly circular in shape, experiencing minimal field distortion over 360 degrees of operation. In FIG. 6(*b*), a vector plot of the azimuth radiation pattern 311 for horizontally-polarized antenna element 23 is shown. As can be seen, azimuth plane pattern 311 is also nearly circular in shape, experiencing minimal field distortion (less than 2 dB) over 360 degrees of operation. Therefore, the superimposition of azimuth radiation patterns 301 and 311 illustrates that the two independent signal feeds generated by orthogonal antenna elements 21 and 23 can be combined together to provide diversity antenna 13 with signal uniformity in all directions and thereby reduce the probability that a cross-polarization null effect would produce a significant signal strength drop in both signal feeds at the same moment.

As such, it is to be understood that diversity antenna system 11 has particular usefulness in conjunction with wireless microphone systems. As noted previously, low-power wireless microphone systems are particularly susceptible to the harmful effects of multi-path interference since wireless microphones are designed for portability and movement by the user. However, because diversity antenna 13 is uniquely constructed to provide signal uniformity in all directions, any variance in the point of origin and/or angle of orientation of an RF signal generated by a wireless microphone would not produce a drop in signal strength in both antenna feeds at the same point in time. Accordingly, the user is not required to maintain the position and/or orientation of either the microphone or diversity antenna 13 in a particular manner in order to treat the harmful effects of multi-path interference, which would otherwise yield signal nulls or dropouts.

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A diversity antenna for receiving radio frequency (RF) signals, the diversity antenna comprising:

(a) a first antenna element for receiving RF signals, wherein the first antenna element is a blade antenna that is vertically polarized, the first antenna element comprising, (i) a planar, vertically-oriented, printed circuit board (PCB) having a front face, a rear face, a fin-shaped upper portion and an enlarged bottom portion, (ii) first conductive strip disposed on the front face of the vertically-oriented PCB within the upper portion, (iii) a second conductive strip disposed on the rear face of the vertically-oriented PCB within the upper portion in direct alignment with the first conductive strip, and (iv) a plurality of plated thru-holes extending transversely through the vertically-oriented PCB, each thru-hole being connection with each of the first and second conductive strips; and (b) a second antenna element for receiving RF signals, the second antenna element comprising a first loop antenna that is horizontally polarized, the second antenna element operating independently of the first antenna element, the second antenna element being coupled to the first antenna element in a fixed orthogonal relationship relative thereto;

(c) wherein the first antenna element produces a generally circular azimuth radiation pattern in the vertical plane and the second antenna element produces a generally circular azimuth radiation pattern in the horizontal plane, the combined radiation patterns reducing any cross-polarization effects in RF signals received by the diversity antenna.

2. The diversity antenna as claimed in claim 1 wherein the first loop antenna comprises:

(a) a horizontally-oriented, printed circuit board (PCB) having a top surface and a bottom surface; and (b) a conductive strip disposed on at least one of the top and bottom surfaces of the horizontally-oriented PCB.

3. The diversity antenna as claimed in claim 2 wherein the horizontally-oriented PCB for the first loop antenna is disc-shaped with a circular outer periphery.

4. The diversity antenna as claimed in claim 3 wherein the conductive strip for the first loop antenna extends along the majority of the outer periphery of the horizontally-oriented PCB.

5. The diversity antenna as claimed in claim 2 wherein the horizontally-oriented PCB for the first loop antenna is shaped to define a centered linear slot which is dimensioned to receive the fin-shaped upper portion of the first antenna element when the diversity antenna in its assembled state.

6. The diversity antenna as claimed in claim 1 wherein the second antenna element comprises a second loop antenna.

7. The diversity antenna as claimed in claim 6 wherein each of the first and second loop antennas of the second antenna element is mounted on the vertically-oriented PCB of the first antenna element in an orthogonal relationship relative thereto.

8. The diversity antenna as claimed in claim 7 wherein the first and second loop antennas of the second antenna element are maintained in a fixed, spaced apart, parallel relationship.

9. A diversity antenna for receiving radio frequency (RF) signals, the diversity antenna comprising:

(a) a first antenna element for receiving RF signals, wherein the first antenna element is a blade antenna that is vertically polarized; and (b) a second antenna element for receiving RF signals, the second antenna element comprising a first loop antenna that is horizontally polarized, the second antenna element operating independently of the first antenna element, the second antenna element being coupled to the first antenna element in a fixed orthogonal relationship relative thereto, wherein the first loop antenna comprises, (i) a first conductive strip disposed on the top surface of the horizontally-oriented PCB, (ii) a second conductive strip disposed on the bottom surface of the horizontally-oriented PCB in direct alignment with the first conductive strip on the horizontally-oriented PCB, and (iii) a plurality of plated thru-holes extending transversely through the horizontally-oriented PCB, each thru-hole being connection with each of the first and second conductive strips on the horizontally-oriented PCB, (c) wherein the first antenna element produces a generally circular azimuth radiation pattern in the vertical plane and the second antenna element produces a generally circular azimuth radiation pattern in the horizontal plane, the combined radiation patterns reducing any cross-polarization effects in RF signals received by the diversity antenna.

10. A diversity antenna for receiving radio frequency (RF) signals, the diversity antenna comprising:

(a) a first antenna element for receiving RF signals, wherein the first antenna element is a blade antenna that is vertically polarized, the first antenna element comprising, (i) a planar, vertically-oriented, printed circuit board (PCB) having a front face, a rear face, a fin-shaped upper portion and an enlarged bottom portion, and (ii) conductive strip disposed on at least one of the front and rear faces of the vertically-oriented PCB within the upper portion, and (b) a second antenna element for receiving RF signals, the second antenna element being horizontally polarized, the second antenna element operating independently of the first antenna element, the second antenna element being coupled to the first antenna element in a fixed orthogonal relationship relative thereto, wherein the second antenna element comprises, (i) a first loop antenna, (ii) a second loop antenna maintained in a fixed, spaced apart, parallel relationship relative to the first loop antenna, and (iii) at least one conductive spacer for conductively coupling the first and second loop antennas in parallel, (iv) wherein each of the first and second loop antennas of the second antenna element is mounted on the vertically-oriented PCB of the first antenna element in an orthogonal relationship relative thereto, (c) wherein the first antenna element produces a generally circular azimuth radiation pattern in the vertical plane and the second antenna element produces a generally circular azimuth radiation pattern in the horizontal plane, the combined radiation patterns reducing any cross-polarization effects in RF signals received by the diversity antenna.

* * * * *